United States Patent [19]

Lé Gardeur

[11] 4,225,806

[45] Sep. 30, 1980

[54] GENERATOR OF METER- OR DECIMETER-LONG WAVES

[75] Inventor: René Lé Gardeur, Grenoble, France

[73] Assignee: Commissariat a l'Energie Atomique, Paris, France

[21] Appl. No.: 914,818

[22] Filed: Jun. 12, 1978

[30] Foreign Application Priority Data

Jun. 27, 1977 [FR] France ..... 77 19619

[51] Int. Cl.[3] ..... H01J 25/02

[52] U.S. Cl. ..... 315/5; 315/4; 315/5.13; 315/39.3; 315/5.51

[58] Field of Search ..... 315/3, 4, 5, 531, 5.51, 315/5.13, 39.3

[56] References Cited

U.S. PATENT DOCUMENTS

| | | | |
|---|---|---|---|
| 2,420,342 | 5/1947 | Samuel | 315/4 X |
| 3,158,779 | 11/1964 | Ayaki | 315/5.13 X |
| 3,175,163 | 3/1965 | Johnson | 315/3 |
| 3,296,542 | 1/1967 | Adler | 315/4 X |
| 3,457,450 | 7/1969 | Feinstein et al. | 315/5 |

*Primary Examiner*—Saxfield Chatmon, Jr.
*Attorney, Agent, or Firm*—Pollock, Vande Sande & Priddy

[57] ABSTRACT

A generator of meter- or decimeter-long waves based on an interaction of the cyclotronic type between a tubular electron beam and an azimuthal field set up in a resonant structure, wherein the said resonant structure comprises a plurality of circular cylindrical sectors separated by capacitive openings.

5 Claims, 5 Drawing Figures

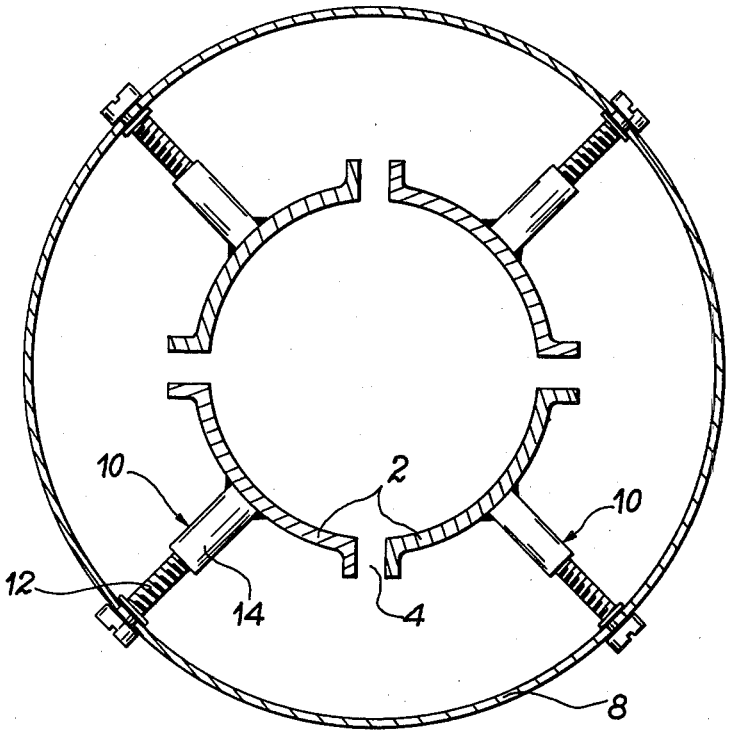
FIG. 3
FIG. 4
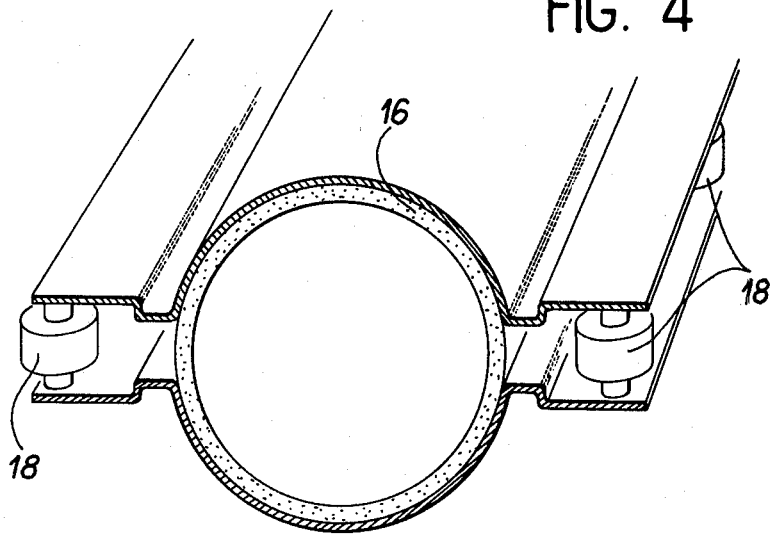

GENERATOR OF METER- OR DECIMETER-LONG WAVES

BACKGROUND OF THE INVENTION

The invention relates to a generator of meter- or decimeter-long electromagnetic waves, consisting of a resonant structure coupled to a tubular beam of electrons in helical orbits.

This generator is based on an interaction between a tubular electron beam, on the one hand, which is given a cyclotronic movement by a static magnetic field, and on the other hand an electromagnetic field with azimuthal distribution set up in a resonant structure, at a frequency close to the cyclotronic frequency of the electrons. Such an interaction is already known per se, but only when the electron beam is coupled to the electromagnetic field of a cylindrical or spherical resonant cavity. It is described, for example, in an article by R. Le Gardeur published in the minutes of the 5th International Congress on Tubes for Hyperfrequencies, Paris, 14–18 September 1964, pages 522 to 526.

The resonant mode used in the interaction described in this article is of the type $TE_{011}$ (for transverse electric) in cylindrical geometry. It is identified by three indices m, n, p which characterize the distribution of the field as a function of the polar angle $\Phi$, the radius r, and the ordinate z counted along the axis, respectively. The electric field corresponding to it has only one tangential component $E_\Phi$, while the radial and axial components are zero and this tangential component is independent of $\Phi$, and undergoes only one alteration along a radius and one alternation along the axis. This mode is termed "azimuthal" or else "magnetic dipole".

This component $E_\Phi$ of the electric field is given quantitatively by a term which is found in all the specialist works dealing with the theory of volumes resonating at hyperfrequencies (and particularly in the work "Microwave Electronics" by J. C. SLATER);

$$E_{101}=A\cdot J_1(x'_{01}r/R)\sin \pi z/L\cdot \sin wt$$

wherein:

$\Phi$, r and z are the cylindrical co-ordinates,

R is the radius of the cavity and L is its length,

A is a constant, $J_1$ is the primary Bessel function and $x'_{01}$ is its primary root, w is the resonance pulsation of the mode.

Near the axis, where r is small compared with R, the Bessel function $J_1(x'_{01}r/R)$ is equivalent to $x'_{01}r/2R$, so that the tangential component of the field is expressed by the approximate equation:

$$E_\Phi=(Ax'_{01}/2R)r\sin(\pi z/L)\sin wt$$

which shows that, when z is fixed, the field increases with r in the vicinity of the axis.

The resonance frequency of a cavity or the associated wavelength, which comes down to the same thing, naturally depends on the dimensions of the cavity. For the mode $TE_{011}$, these parameters satisfy the equation:

$$\frac{D}{\lambda}=\sqrt{1.49+\left(\frac{D}{2L}\right)^2}$$

where D is the diameter of the cavity, L is its length and $\lambda$ is the wavelength.

FIG. 1 shows the variation of $D\lambda$ as a function of L/D, taken as the variable. It appears that the diameter D is always of the order of several wavelengths and, in any case, is greater than $\sqrt{1.49}$, namely 1.22 times the wavelength.

When the range of operation of the electronic tube is within the range of centimeter waves, the cavity therefore has a diameter of the order of 5 to 10 cm, which does not present any special problems. However, with wavelengths of 30 cm or more (i.e. a frequency of 1000 MHz), the diameter of the cavity is already at least 36 cm, and at 3 m (150 MHz) the diameter assumes a value of 360 cm, which is prohibitive for most purposes.

The length L naturally follows similar variations. Therefore, it is out of the question to use such cavities for generating waves which are tens of centimeters or meters long, with the result that the generators of the type described in the abovementioned publication are ill suited for the production of waves measuring several meters or tens of centimeters in length.

BRIEF SUMMARY OF THE INVENTION

The present invention relates precisely to a generator of this kind not having this disadvantage, in that its dimensions are smaller than those of a generator using a cylindrical cavity for the same resonance frequency.

This result is obtained, according to the invention, by using a structure which comprises a plurality of circular cylindrical sectors separated by capacitive openings.

Preferably, to prevent radiation into the surroundings and to improve the overpressure, the structure also comprises external cylindrical armor plating.

In addition to the advantage described above, namely the reduction in dimensions, the invention has the advantage of enabling the resonance frequency of the structure to be adjusted by modifying the diameter, which was not the case in the prior art. For this purpose, each sector is preferably connected to the outer armor plating by supports of adjustable length.

In order to enable a forced vacuum to be maintained in the interaction space, the entire structure may be surrounded by a leaktight casing; however, in an advantageous variant, only the inner cylindrical part has a casing of this kind. The latter should therefore show only low dielectric losses at hyperfrequencies.

BRIEF DESCRIPTION OF THE DRAWINGS

In any case, the features and advantages of the invention will become more apparent from the following description of exemplary embodiments given as a guide, without being restrictive in any way, with reference to the accompanying drawings, wherein:

FIG. 3 shows a particular embodiment of a structure with an adjustable resonance frequency;

FIG. 4 shows a particular embodiment of a leaktight resonant structure; and

DETAILED DESCRIPTION OF THE PREFERRED EMBODIMENTS

Figure 1:
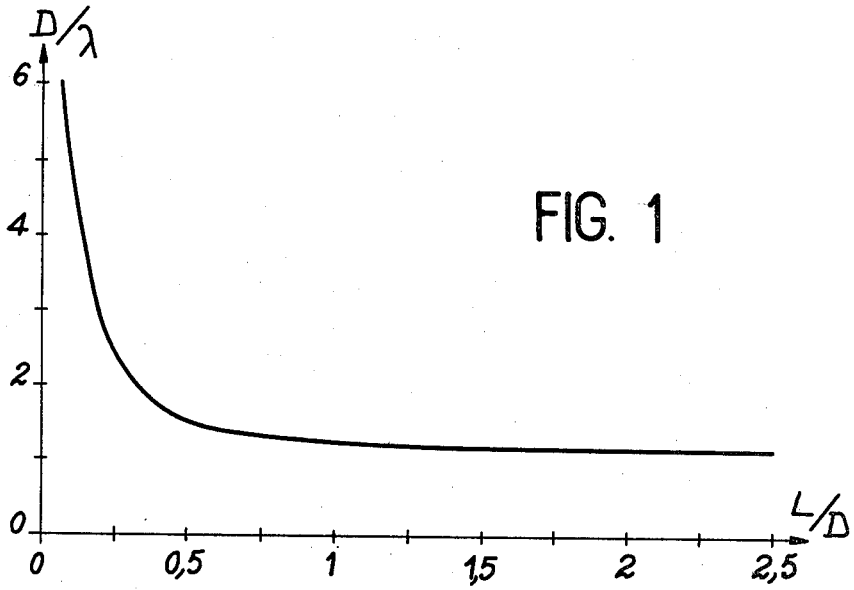
FIG. 1 shows the curve illustrating the variations in dimensions of a cylindrical cavity as a function of the resonance wavelength.

The essentials of FIG. 1 have already been described. By way of a comparison, it may be added that the overall diameter of a resonant structure according to the invention is of the order of half the operational wavelength, which means that, if one takes a ratio $D/\lambda$ of 1.22 for the cylindrical cavities, the reduction factor of the diameter, from the cylindrical structures of the prior art to the structures according to the invention, is of the order of 2.5. This factor may be greater in certain cases for less energetic electron beams, as will be seen hereinafter.

Figure 2:
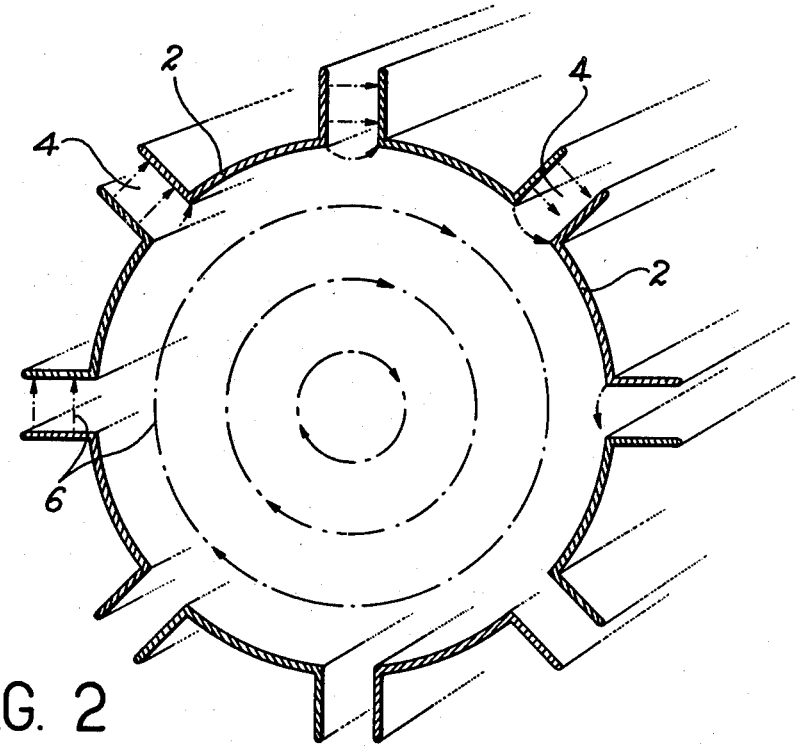
FIG. 2 shows a section through the resonant structure used in the generator according to the invention.

The structure which is part of the generator according to the invention is shown in FIG. 2. It comprises a plurality of circular cylindrical sectors 2 separated by capacitive openings 4. This structure is made of copper or brass, for example. The lines of the electric field 6 are shown in this Figure for the basic azimuthal mode. Near the axis, the electric field is purely azimuthal and has only one component $E_\Phi$. In the capacitive openings, the field is perpendicular to the walls. Between these extreme areas, the distribution is more complex. It can be calculated using the conventional method, which consists in resolving the Maxwell equations, taking into account the angular periodicity of the structure. Calculation of this kind is outside the scope of the present description, but reference can be made to the classic works which deal with this type of problem, particularly the work mentioned hereinbefore, in which a study is made of the distribution of the field in the interaction space of a magnetron where the symmetry is of the same order.

To simplify matters, it can be stated here that the axial zone of the structure is inductive in character and the peripheral zone is capacitive in character. The addition of this latter, compared with purely cylindrical cavities, results in a reduction in the resonance frequency when the dimensions are the same; reciprocally, the internal diameter of the structure in FIG. 2 is less than the diameter of a cylindrical cavity of the same resonance frequency for the same mode.

The structure as shown in FIG. 2 radiates electromagnetic energy. If it is desired to suppress this radiation totally in order to obtain maximum overpressure, the structure may be surrounded with armor plating 8, as shown in FIG. 3. In this case, the presence of this armor plating or of these additional walls modifies the resonance frequency of the structure.

FIG. 3 also illustrates a particular embodiment wherein the sectors are held in place by supports 10 connected to the plating and having a variable length. In the Figure, and by way of explanation, these supports consist of a screw 12 which is accessible from outside, and which engages in a small column 14; however, other systems could also be used. These supports 10 may be made from conductive or insulating material.

The advantage of this arrangement is that it enables the internal diameter of the resonant structure and the width of the capacitive zone to be modified, thus permitting the operator to regulate the resonance frequency of the structure. In practice, the only way to vary the resonance frequency of a cylindrical cavity consists in altering the position of a movable lid. However, it is not possible to do that here, as the axis of the cavity must be kept freely accessible. The possibility of varying the diameter of the resonant structure therefore becomes all-important.

Since the structure according to the invention constitutes the resonant circuit of an electron tube, it is essential for the space in which the electrons interact and the field to be maintained under a forced vacuum. This space is the axial zone of the structure, at the point where the field has a purely azimuthal distribution. For this purpose, the structure comprises, as shown in FIG. 4, a tube 16 made of leaktight material which has low dielectric losses at the operational frequencies. It may be, in particular, a ceramic tube.

In some cases, if it is desired to reduce the resonance frequency of the structure still further without increasing its overall dimensions, it is possible to add localized capacitive elements to the openings, as shown in FIG. 4 where these elements are marked with reference numeral 18.

Figure 5:
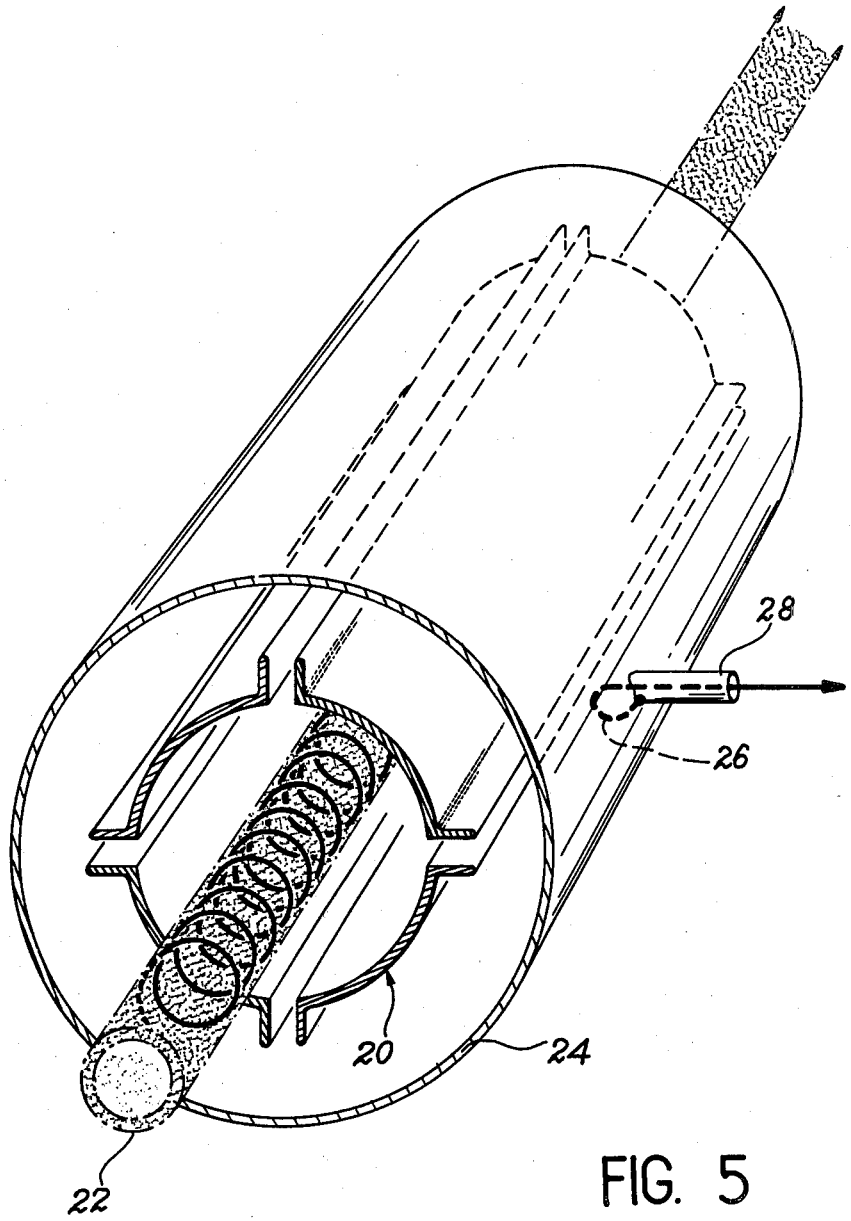
FIG. 5 diagrammatically shows the entire generator according to the invention.

FIG. 5 diagrammatically shows the essential elements of the generator of meter- or decimeter-long waves according to the invention.

The generator in FIG. 5 comprises a resonant structure 20 through which passes a tubular beam of electrons 22 travelling in a helical orbit, an outer casing 24 of armor plating, a coupling loop 26 directed perpendicularly to the lines of the high frequency magnetic field, and a coaxial line 28 connected to the operating means.

In a generator of this kind, the dimensions of the resonant structure and, in particular, the internal diameter are largely determined by the diameter of the tubular electron beam. In fact, to allow the beam to perform radial movements when it interacts with the electromagnetic field, the internal diameter of the structure must be of the order of at least twice the diameter of the tubular electron beam. In fact, this latter is a function of the acceleration potential of the electrons in the gun which precedes the interaction zone. This potential is of the order of 40 kV at most, which gives the beam a diameter of the order of $\lambda/8$. In this case, the diameter of the resonant structure is of the order of $\lambda/4$. Since the armor plating has a diameter which is approximately twice that of the resonant structure itself, the whole has an overall diameter of the order of $\lambda/2$. If this value is compared with that of the cylindrical cavities, which is at least $1.22\lambda$, it will be seen that there is a ratio of at least 2.5 to the advantage of the structure according to the invention, as specified hereinbefore.

When the acceleration potential falls from 40 to 25 kV, the ratio of dimensions reaches 3.5. It may be increased still further at low frequencies (meter-long waves) when the diameter of the armor plating is designed to be less than twice the internal diameter of the structure.

The result of these considerations is that the bulk of a generator of the type described is reduced for the same wavelength, if the structure according to the invention is used or, conversely, the wavelength can be reduced with a structure of the same bulk.

The invention is not limited to the embodiments described and represented hereinbefore and various modifications can be made thereto without passing beyond the scope of the invention.

What is claimed is:

1. In a generator of meter or decimeter long electromagnetic waves based on an interaction of the cyclotronic type between a tubular electron beam given a cyclotronic movement by a static magnetic field, and an electromagnetic field having $TE_{011}$ distribution, the improvement comprising a circular cylindrical resonant cavity comprising a plurality of circular cylindrical sectors separated by capacitive openings.

2. A generator according to claim 1, wherein said resonant cavity further comprises external cylindrical armor plating.

3. A generator according to claim 2, wherein each sector of said resonant cavity is connected to the external armor plating by supports of adjustable length.

4. A generator according to claim 1, wherein a leak-tight cylinder made of a material which is dielectric at hyperfrequencies is arranged inside the sectors of said resonant cavity.

5. A generator according to claim 2, wherein said resonant cavity comprises a coupling loop one end of which is connected to said wall of the armor plating.

* * * * *